US008736651B2

(12) United States Patent
Nakahata

(10) Patent No.: US 8,736,651 B2
(45) Date of Patent: May 27, 2014

(54) OPTICAL SCANNING APPARATUS AND COLOR IMAGE FORMING APPARATUS THEREWITH

(71) Applicant: Canon Kabushiki Kaisha, Tokyo (JP)

(72) Inventor: Hiroshi Nakahata, Abiko (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/748,868

(22) Filed: Jan. 24, 2013

(65) Prior Publication Data

US 2013/0194372 A1 Aug. 1, 2013

(30) Foreign Application Priority Data

Jan. 30, 2012 (JP) ..... 2012-016663

(51) Int. Cl.
*B41J 2/435* (2006.01)

(52) U.S. Cl.
USPC ..... 347/236; 347/246

(58) Field of Classification Search
USPC ..... 347/229, 234–237, 246–250
See application file for complete search history.

(56) References Cited

U.S. PATENT DOCUMENTS 5,241,174 A * 8/1993 Ando ..... 250/235
5,418,638 A * 5/1995 Hirasawa ..... 359/197.1
5,442,171 A * 8/1995 Anzai ..... 250/235
5,615,038 A * 3/1997 Suzuki et al. ..... 359/210.1
5,831,167 A * 11/1998 Andersen ..... 73/602
5,841,465 A * 11/1998 Fukunaga et al. ..... 347/258
6,118,570 A * 9/2000 Kanai et al. ..... 359/210.1
6,417,509 B1 * 7/2002 Atsuumi et al. ..... 250/234
7,602,554 B2 * 10/2009 Mogi ..... 359/641
7,817,176 B2 * 10/2010 Masuda ..... 347/241
7,869,110 B2 * 1/2011 Nakamura et al. ..... 359/205.1

FOREIGN PATENT DOCUMENTS

JP 09-146025 A 6/1997
JP 2008-122613 A 5/2008
JP 2010-096898 A 4/2010

* cited by examiner

*Primary Examiner* — Hai C Pham
(74) *Attorney, Agent, or Firm* — Rossi, Kimms & McDowell LLP

(57) ABSTRACT

An optical scanning apparatus that is capable of increasing use life of a semiconductor laser by decreasing the emission time for sensors that are independently provided for synchronous control, light control, and focus control. A laser beam emitted from a light source is deflected by a deflector, and scans a photoconductor. A beam splitter arranged between the light source and the deflector separates the laser beam, which is detected by a first detection unit. A second detection unit arranged in a non-image forming area detects the deflected laser beam to detect defocus amount. A focusing unit focuses the scanning laser beam based on a detection result of the second detection unit. A control unit controls the light amount of the laser beam applied to an image forming area based on a detection result of the first detection unit at the timing when the second detection unit detects the laser beam.

6 Claims, 9 Drawing Sheets

OPTICAL SCANNING APPARATUS AND COLOR IMAGE FORMING APPARATUS THEREWITH

BACKGROUND OF THE INVENTION

1. Field of the Invention

The present invention relates to an optical scanning apparatus with a semiconductor laser, and a color image forming apparatus that is provided with this optical scanning apparatus like a copying machine or a printer with an electrophotography system.

2. Description of the Related Art

An optical scanning apparatus that is mounted in an image forming apparatus for printing an image using an electrophotography process is generally configured to reflect a laser beam emitted from a light emission unit by a rotating polygon mirror, and to form a linear electrostatic latent image by scanning a photoconductive drum with a spot formed on the photoconductive drum through an fθ lens.

Such an optical scanning apparatus is provided with a BD sensor that detects light receiving timing of the laser beam at a position outside a image forming area in order to acquire a synchronized signal for determining a rendering start point. In order to perform light control (Auto Power Control: APC) so as to keep a density of an image in a predetermined level, an APC sensor that detects the light amount of the laser beam is required.

The BD sensor preferably detects the laser beam that scans in the same speed as the beam scans on the photoconductive drum. On the other hand, the APC sensor preferably detects the laser beam that scans in lower speed than the scanning speed on the photoconductive drum in order to detect light amount correctly, and preferably uses an optical system of which focal length is shorter than that of the optical system for rendering. Japanese Laid-Open Patent Publication (Kokai) No. H9-146025 (JP H9-146025A) discloses a configuration that uses one sensor as both the BD sensor and the APC sensor. However, the configuration disclosed in this publication cannot detect the laser amount of each laser beam correctly, particularly when a plurality of laser beams are used, because the scanning speed of the laser beam that runs across the sensor is too high. That is, the BD sensor and the APC sensor should be provided independently in order to detect light amount correctly.

In an image forming apparatus, variations of a position of each optical element and refractive index of each lens due to heat produced by various heat sources, such as motors, a fixing heater, and a power source, deviate a converging position of the laser beam from the photosensitive drum, which enlarges the diameter of spot formed on the photoconductive drum.

Especially, since a high-definition optical scanning apparatus of which the spot diameter is small becomes shallow in focal depth at the side of the photoconductive drum, the spot diameter remarkably expands due to the influence of heat. Such an apparatus needs to detect change (defocus amount) of the converging position of laser beam with an autofocus (AF) sensor and to correct the change with an AF mechanism.

Japanese Laid-Open Patent Publication (Kokai) No. 2008-122613 (JP 2008-122613A) discloses a configuration that uses one sensor as both the BD sensor and the AF sensor. The focus detection method disclosed in this publication moves a collimator lens in an optical axis direction so as to maximize the peak of differential value of the sensor output (light amount) using characteristics that the peak of differential value of the sensor output at the time when the laser beam runs across the sensor increases as the spot size decreases.

However, since the technique of JP 2008-122613A only detects the defocus amount in the principal scanning direction, it is insufficient for applying to an anamorphic optical system in which powers are different in a principal scanning direction and an auxiliary scanning direction.

On the other hand, Japanese Laid-Open Patent Publication (Kokai) No. 2010-096898 (JP 2010-096898A) discloses an optical scanning apparatus provided with an AF mechanism that is suitable for an anamorphic optical system. The apparatus disclosed in this publication is provided with a separator lens and an AF sensor. The separator lens has four lens parts for dividing a laser beam passed through an fθ lens into four spots (two spots divided in the principal scanning direction and two spots divided in the auxiliary scanning direction). The AF sensor detects a gap between the two spots divided in the principal scanning direction as defocus amount in the principal scanning direction, and detects a gap between the two spots divided in the auxiliary scanning direction as defocus amount in the auxiliary scanning direction. The apparatus moves a collimator lens and a cylindrical lens in the optical axis direction based on the defocus amounts in the principal scanning direction and the auxiliary scanning direction.

However, since the AF sensor is not suitable for detecting the light amount of the laser beam and the light receiving timing in the configuration that detects the defocus amount by dividing the laser beam as disclosed in JP 2010-096898A, the AF sensor cannot be used as both suitable for detecting the light amount and the light receiving timing of a laser beam, and the AF sensor cannot be used as a BD sensor or an APC sensor.

Accordingly, the optical scanning apparatus using a plurality of laser beams and an anamorphic optical system needs exclusive sensors for the synchronous control, the light control, and the focus control, respectively. However, when three kinds of sensors are arranged side by side outside the image forming area, the emission time for the APC sensor, the emission time for the BD sensor, and the emission time for the AF sensor are added to the emission time for forming an image. Accordingly, the emission time of the light emission unit with a semiconductor laser increases, which causes a problem of shortening the use life of the semiconductor laser.

SUMMARY OF THE INVENTION

The present invention provides an optical scanning apparatus and a color image forming apparatus therewith, which are capable of increasing use life of a semiconductor laser by decreasing the emission time for sensors that are independently provided for the synchronous control, the light control, and the focus control.

Accordingly, a first aspect of the present invention provides an optical scanning apparatus comprising a light source configured to emit a laser beam, a deflector configured to deflect the laser beam so that the laser beam emitted from the light source scans a photoconductor, a beam splitter configured to separate the laser beam emitted from the light source toward the deflector, the beam splitter being arranged between the light source and the deflector on an optical path of the laser beam, a first detection unit configured to detect a laser beam separated from the laser beam emitted from the light source toward the deflector, an optical element configured to guide the laser beam deflected by the deflector to the photoconductor, a second detection unit configured to detect the laser beam deflected by the deflector in order to detect defocus amount of the laser beam guided to the photoconductor, the second detection unit being arranged at a position corresponding to a non-image forming area outside an image forming area of the photoconductor, a focusing unit configured to focus the scanning laser beam onto the photoconductor based on a detection result of the second detection unit, and a control unit configured to control the light amount of the laser beam applied to the image forming area based on a detection result of the first detection unit that detects the laser beam separated by the beam splitter at the timing when the second detection unit detects the laser beam emitted from the light source.

Accordingly, a second aspect of the present invention provides a color image forming apparatus equipped with the optical scanning apparatus according to the first aspect, wherein the control unit controls the focusing unit to focus at the timing of a color registration when the defocus amount detected by the second detection unit exceeds a threshold value.

Accordingly, a third aspect of the present invention provides a color image forming apparatus equipped with the optical scanning apparatus according to the first aspect, wherein the control unit controls the focusing unit to focus in inter-paper time during which an image is not formed when the defocus amount detected by the second detection unit exceeds the threshold value.

According to the present invention, the use life of the semiconductor laser is increased by decreasing the emission time for sensors that are independently provided for the synchronous control, the light control, and the focus control.

Further features of the present invention will become apparent from the following description of exemplary embodiments with reference to the attached drawings.

DESCRIPTION OF THE EMBODIMENTS

Hereafter, embodiments according to the present invention will be described in detail with reference to the drawings.

Figure 1A:
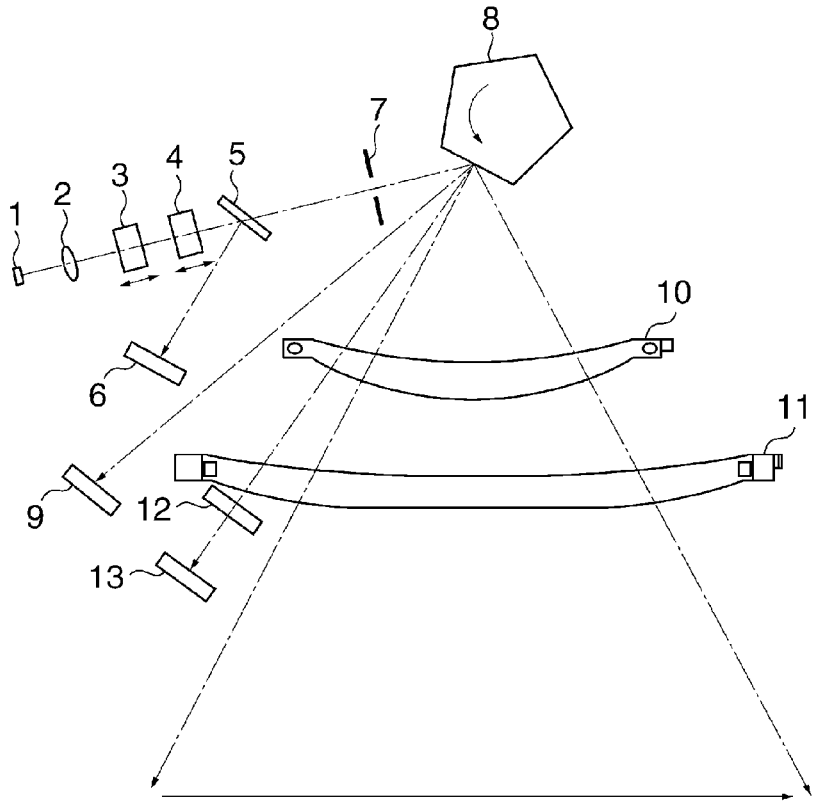
FIG. 1A is a plan view showing a configuration of an optical scanning apparatus according to an embodiment of the present invention.

An optical system of an optical scanning apparatus according to the embodiment is provided with a laser light source 1 including a semiconductor laser that emits a laser beam based on image information, a collimator lens 2 that converts the laser beam emitted from the light emitting unit 1 into a parallel beam, a first cylindrical lens 3 that is supported so as to be movable in an optical axis direction and has refractive power in a principal scanning direction, a second cylindrical lens 4 that is supported so as to be movable in the optical axis direction and has refractive power in an auxiliary scanning direction, and a beam splitter that partially reflect the laser beam as shown in FIG. 1. This optical system is further provided with a light amount detection sensor (an APC sensor, a first detection unit) 6 that detects the light amount of the laser beam reflected by the beam splitter 5, a stop 7 that defines the spot diameter, and a polygon mirror 8 that deflects the laser beam. The APC sensor 6 functions as a light amount detection unit that detects the light amount of the laser beam separated from the laser beam emitted from the laser light source 1 toward the polygon mirror 8.

Furthermore, this optical scanning apparatus is provided with a first imaging lens 10 and a second imaging lens 11 that converge the laser beam reflected by the polygon mirror 8 to form a spot that scans at uniform velocity on a photoconductive drum (an image bearing member, not shown). The first and second imaging lenses 10 and 11 function as an fθ lens (an imaging optical system), and an electrostatic latent image is formed by scanning the spot on the photoconductive drum.

Figure 6:
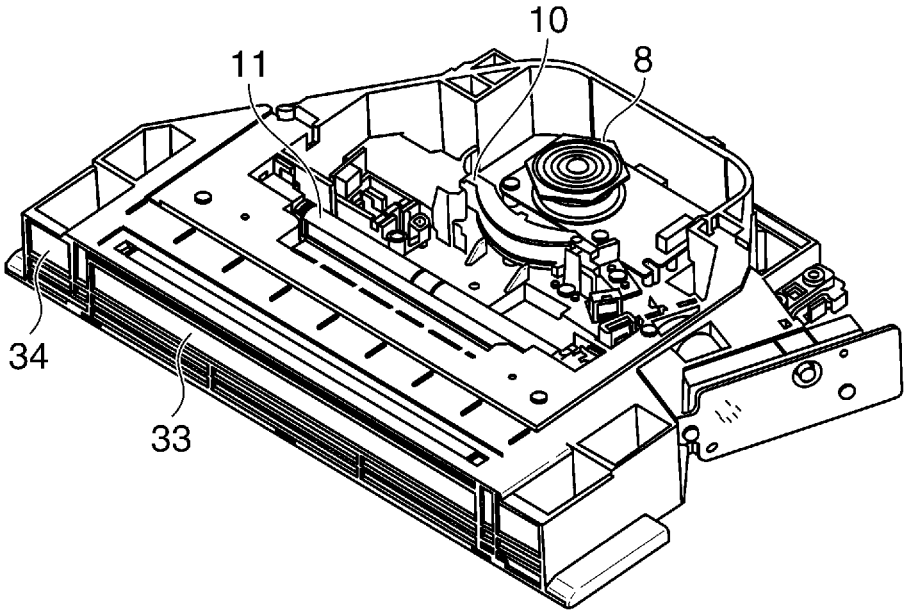
FIG. 6 is a perspective view schematically showing a configuration of the image forming apparatus according to the embodiment.
Figure 7:
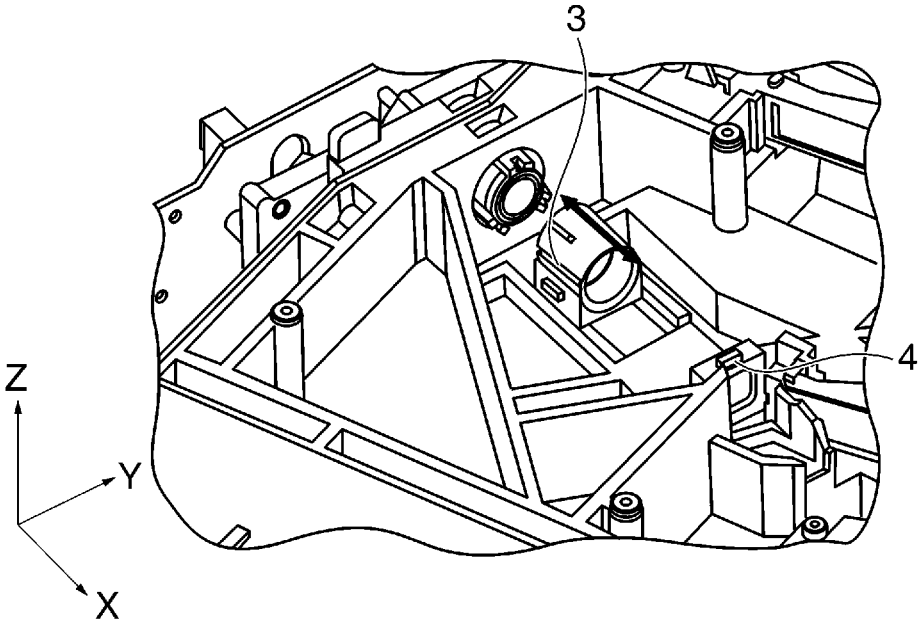
FIG. 7 is a perspective view schematically showing a principal configuration of a focusing mechanism that is taken out from the optical scanning apparatus according to the embodiment.

The optical system of the optical scanning apparatus is contained in the housing 34 as shown in FIG. 6. A dustproof glass plate 33 is arranged at a window of the housing 34 through which the deflected laser beam passes. The top opening of this housing 34 is covered by a top cover (not shown) and the inner space of the housing 34 is isolated from outside. As shown in FIG. 7, the first and second cylindrical lenses 3 and 4 are attached to the housing 34 so as to be movable in the optical axis direction.

This optical scanning apparatus is provided with a BD sensor 9 that generates a reference signal for aligning a writing start position of an image and a defocus detection unit that detects defocus amount of the laser with respect to the photoconductive drum. The BD sensor 9 and the defocus detection unit are arranged outside the image forming area. The defocus detection unit is provided with a separator lens 12 that divides and converges the laser beam passing through the first and second imaging lenses 10 and 11, and an AF (autofocus) sensor 13 (a second detection unit) that receives the laser beams divided and converged by the separator lens 12.

The separator lens 12 has four lens portions. Two of the four portions are separated in the principal scanning direction, divide the laser beam by the boundary of the two portions, and converge the divided laser beams. The other two of the four portions are separated in the auxiliary scanning direction, divide the laser beam by the boundary of the other two portions, and converge the divided laser beams.

The AF sensor 13 is a CCD sensor or a CMOS sensor having light receiving areas (pixels) arranged two-dimensionally. The AF sensor 13 is configured as a light receiving element that is arranged at a position corresponding to a non-image forming area outside an area in which an image is formed on an image bearing member and receives the laser beam deflected by the polygon mirror 8.

Figure 8A:
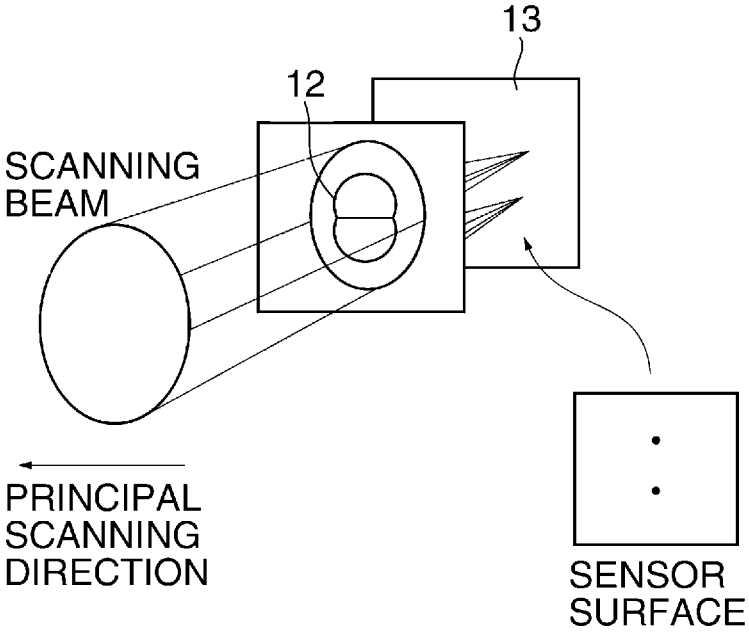
FIG. 8A and FIG. 8B are views schematically showing a unit for detecting defocus in the optical scanning apparatus according to the embodiment.

Next, the configuration for detecting a focusing state will be described with reference to FIG. 8A, FIG. 8B, FIG. 9, and FIG. 10. FIG. 8A is a schematic view showing a relation between a scanning light flux 39 and an AF optical system that includes the separator lens 12 and the AF sensor 13. With the configuration shown in FIG. 8A, the laser beam with thick diameter is incident to the separator lens 12 immediately after passing the fθ lens. Then, the AF sensor 13 detects the divided beam imaged by the separator lens 12.

With the configuration shown in FIG. 8A, since the lens portions are separated in the auxiliary scanning direction by the boundary in the principal scanning direction, the laser beams are imaged at two points that are separated in the auxiliary scanning direction as shown in the sensor surface in FIG. 8A, which enables to detect the defocus amount in the auxiliary scanning direction.

Figure 8B:
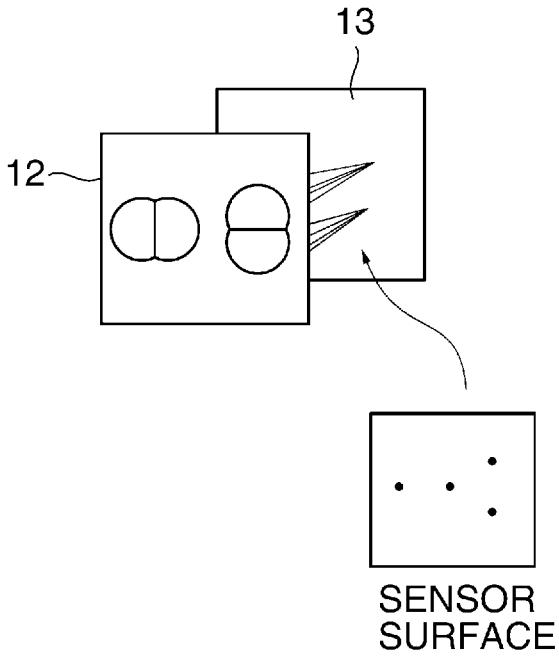

When the AF optical system is configured as shown in FIG. 8B, since the lens portions are also separated in the principal scanning direction by the boundary that intersects perpendicularly with the principal scanning direction, the defocus amount in the principal scanning direction can also be detected. In this case, the laser beams divided in the auxiliary scanning direction form two imaging points separated in the vertical direction at the right area of the sensor surface, and the laser beams divided in the principal scanning direction form two imaging points separated in the horizontal direction in the center level of the sensor surface. It should be noted that the positions of the two imaging points separated in the auxiliary scanning direction vary only in the vertical direction and the positions of the two imaging points separated in the principal scanning direction vary only in the horizontal direction. Accordingly, the defocus in the auxiliary scanning direction is detected by measuring the distance between the imaging points aligned in the vertical direction, and the defocus in the principal scanning direction is detected by measuring the distance between the imaging points aligned in the horizontal direction.

Figure 9:
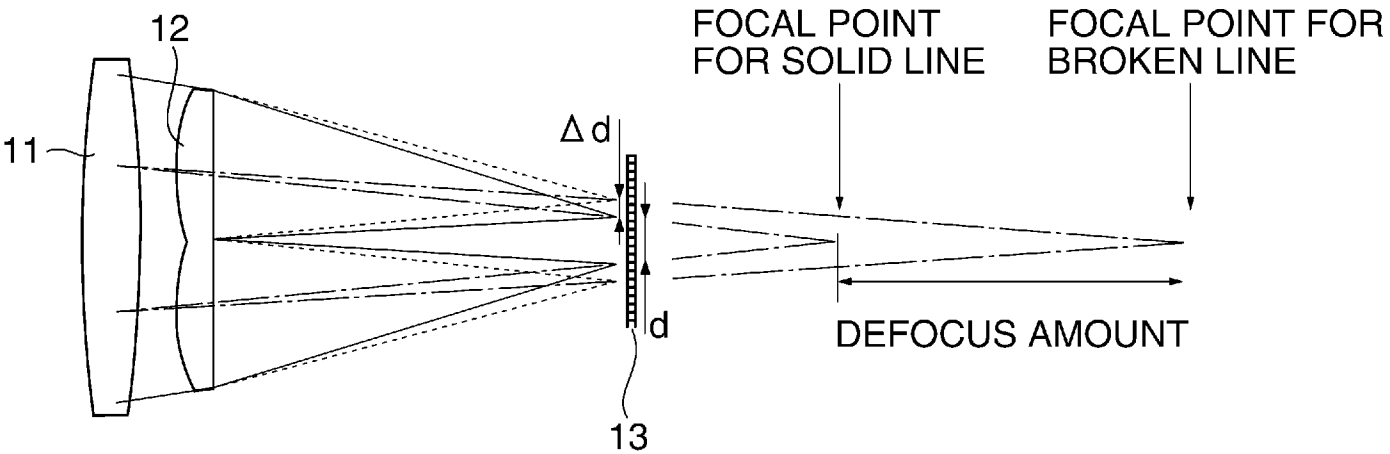
FIG. 9 is a view schematically showing the unit for detecting the defocus amount in the optical scanning apparatus according to the embodiment.

Next, the principle for detecting defocus amount using the separator lens 12 will be described with reference to FIG. 9. It should be noted that the separator lens 12 is described as what has two lens portions in FIG. 9. In FIG. 9, solid lines show the laser beams in the ideal condition where the defocus does not occur, and broken lines show the laser beams in a condition where the defocus occurs. Alternate long and short dash lines show the chief rays of the laser beams shown with the solid lines and the broken lines.

This separator lens 12 has optic axes for the respective lens portions. For this reason, the laser beams incident into the separator lens 12 are imaged at two positions on the AF sensor 13. A design distance between the two points when the defocus does not occur is "d". On the other hand, when the defocus occurs with increasing temperature of the apparatus, the imaging points moves by Δd with respect to the imaging point of no defocus as shown in FIG. 9.

Figure 10:
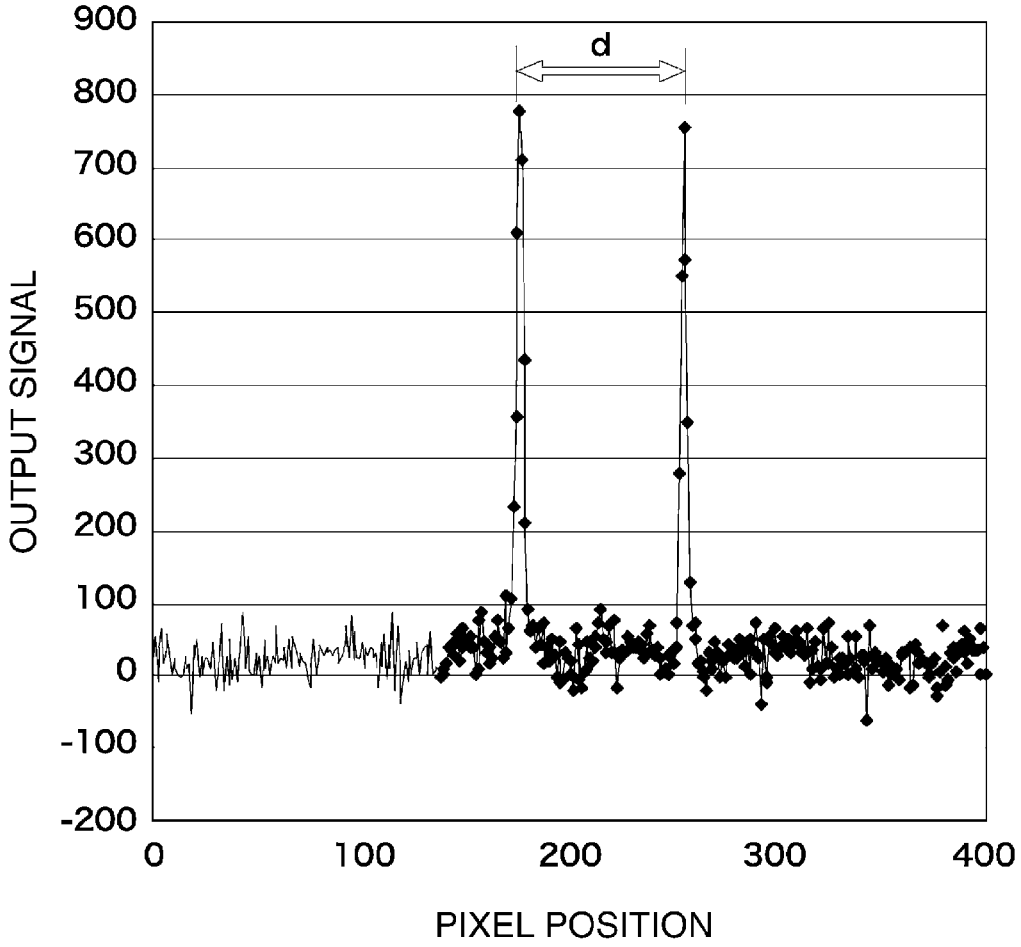
FIG. 10 is a graph showing an output signal from an AF sensor used for detecting the defocus amount in the optical scanning apparatus according to the embodiment.

FIG. 10 is a graph showing an output signal from a CCD sensor used as the AF sensor 13. The signal level rises at the positions to which the laser beams are converged by the separator lens, and two peaks appear.

A distance (the number of pixels) between the peaks (inter-peak distance) is detected based on the data acquired from the AF sensor 13. Since the relation between the inter-peak distance and the defocus amount is acquired in a design phase, the defocus amount can be detected by comparing the detected inter-peak distance with the distance of no defocus.

In the optical scanning apparatus according to the embodiment, the temperature in the housing 34 rises quickly with the heat that is generated when the polygon motor for rotating the polygon mirror 8 at high velocity is driven at the time of an image formation. Then, the refractive index of a lens in the optical scanning apparatus varies with the thermal expansion and the temperature rise of each part. Furthermore, the semiconductor laser changes its oscillation wavelength with the temperature rise.

Moreover, the temperature rise inside the housing 34 over time generates the defocus in the laser beam imaged on the photoconductive drum. In the anamorphic optical system in which the power in the principal scanning direction differs from that in the auxiliary scanning direction, the sensitivity of the defocus amount with respect to heat in the principal scanning direction differs from that in the auxiliary scanning direction. For this reason, the defocus in the principal scanning direction of the laser beam must be corrected by using the lens having the power in the principal scanning direction, and the defocus in the auxiliary scanning direction of the laser beam must be corrected by using the lens having the power in the auxiliary scanning direction.

Accordingly, as shown in FIG. 7, this optical scanning apparatus is equipped with the first cylindrical lens 3 having the power only in the principal scanning direction (the direction of Y in FIG. 7) and the second cylindrical lens 4 having the power only in the auxiliary scanning direction (the direction of Z in FIG. 7). These lenses 3 and 4 are mounted so as to be movable along the optical path of the laser beam and are driven with drive motors (not shown). That is, these lenses 3 and 4 are configured to be movable along the optical path of the laser beam and are adjusted with a moving mechanism (the drive motors (not shown)) in order to change the focus of the laser beam. Then, at the time of focusing, the drive motors are controlled based on the defocus amounts detected by the AF sensor 13 to move the lenses 3 and 4 for correcting the defocus amounts, respectively, and the focus positions in the principal scanning direction and the auxiliary scanning direction are adjusted independently. The lenses 3 and 4 and the drive motors function as a focusing unit that focuses the laser beam to the photoconductive drum.

Figure 1B:
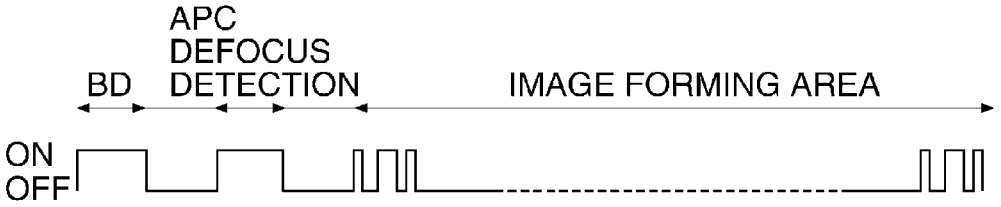
FIG. 1B is a view showing the light emission sequence of the optical scanning apparatus concerning the embodiment.

Next, the light emission sequence of this optical scanning apparatus will be described with reference to FIG. 1B. In this light emission sequence, the synchronous control, the light control, and the focus control are executed by emitting the semiconductor laser of the laser light source 1 twice in the non-image forming area. That is, the laser light source 1 is driven to emit a laser beam while rotating the polygon mirror 8, and the laser beam is detected by the BD sensor 9 in order to determine the timing of a start of one scan period. Then, the CPU 48 makes the semiconductor laser emit in order to detect the defocus and performs the APC at the timing when a counter detects the lapse of a predetermined time from the start timing of the one scan period and when the laser beam impinges on the AF sensor 13. The CPU 48 keeps the emission of the laser beam during a period that is necessary for the AF sensor (CCD sensor) 13 to detect the defocus amount, and then stops. Moreover, the CPU 48 starts to drive the detects a laser beam by BD sensor 9, by measuring at a counter, it is the timing which starts the scan for image formations by a laser beam from the writing start position of an imaging range, and starts the drive of the laser light source 1. Next, the CPU 48 stops driving the laser light source 1 at the timing when the scanning laser beam reaches a writing end position in the image forming area that is detected by counting with the counter. It should be noted that the CPU 48 controls to drive the laser light source 1 by measuring with the counter so that the laser beam is detected by the BD sensor 9 from the next scan period.

Thus, since the APC is performed at the timing when the defocus amount is detected with the AF sensor, the addition of the AF control does not increase the laser emission time and does not shorten the use life of the semiconductor laser.

Next, the configuration for correcting the defocus of the optical scanning apparatus that has a plurality of light emission points will be described with reference to FIG. 2 and FIG. 3.

Figure 2:
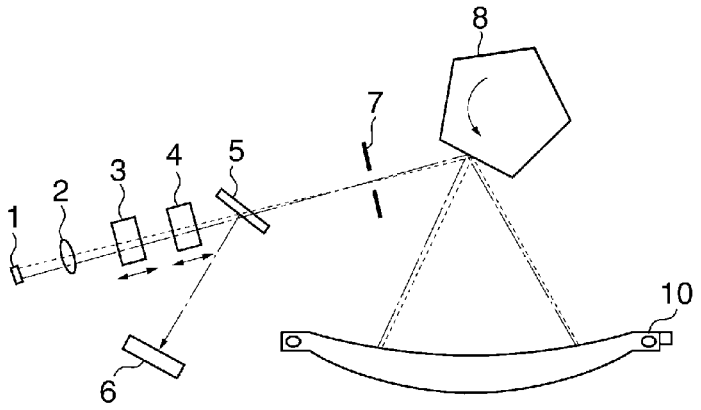
FIG. 2 is a plan view showing laser beam paths in the optical scanning apparatus according to the embodiment when multiple laser beams are used.

In this optical scanning apparatus, two laser beams emitted from the laser light source 1 travel along the optical paths shown by an alternate long and short dash line and a broken line in FIG. 2, respectively. FIG. 2 illustrates the optical paths of the two laser beams emitted from specific two of the light emission points of the laser light source 1. As shown by the two optical paths in FIG. 2, the laser beams emitted from the laser light source 1 travel in parallel to the optical axis to the collimator lens, and travel so that the beams intersect with each other by means of an aperture after passing through the collimator lens 2. Accordingly, the laser beams differ in the incident positions and angles to the polygon mirror 8.

Furthermore, the laser beams reflected by the polygon mirror 8 transmit the different portions of the fθ lens, and are imaged on the photoconductive drum.

Figure 3:
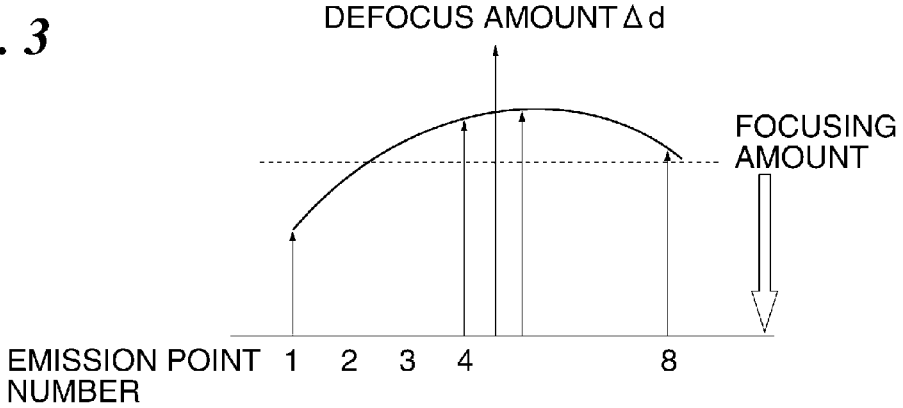
FIG. 3 is a graph showing variation in defocus amount of laser beams emitted from light emission points in the optical scanning apparatus according to the embodiment.

This optical scanning apparatus may cause a difference in the defocus among the light emission points as shown in FIG. 3. Such a difference is caused by three reasons. The first reason is that the laser beams transmit different points with respect to the optical axis of the collimator lens 2. The second reason is that the laser beams transmit different portions of the fθ lens. The third reason is that the light emission points in the semiconductor laser are mounted with inclination in the focusing direction.

The optical scanning apparatus measures the defocus amount of the light emission point (No. 4) that is the closest to the optical axis and the defocus amounts of the light emission points (No. 1 and No. 8) that are the farthest from the optical axis, respectively, in order to correct the defocus in consideration of the difference in the defocus among the light emission points. Then, the average value of the defocus amounts of the respective light emission points is used as the correction value as shown in FIG. 3, and the defocus amount of a specific light emission point does not differ greatly than others.

Figure 4:
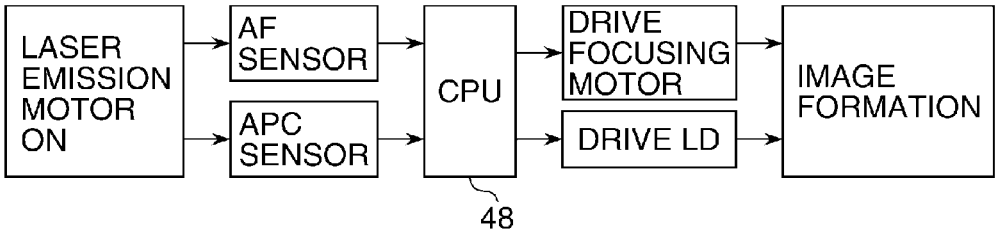
FIG. 4 is a block diagram showing a process performed by the optical scanning apparatus according to the embodiment when a job starts.

Next, a process when a job is supplied to the image forming apparatus and an image formation starts will be described with reference to the block diagram in FIG. 4. In this optical scanning apparatus, when the image formation starts, the rotation of the polygon motor of the optical scanning apparatus is started, and the emission preparation of the semiconductor laser is started.

When the rotation of the polygon motor reaches rated speed, the laser beams are emitted at predetermined timing, the APC sensor and the AF sensor detect light amount and defocus simultaneously, and the CPU 48 calculates a light-control correction value and a defocus amount. Next, this optical scanning apparatus corrects the light amount of the laser beams according to the calculated correction value, corrects the defocus by controlling the driving motors when the defocus amount exceeds a threshold value, and forms an image.

Next, a focusing process in the optical scanning apparatus will be described with reference to flowcharts shown in FIG. 5A, FIG. 5B, and FIG. 5C. If the focusing process is performed during printing one sheet, the spot size will change and image quality will change. Accordingly, the focusing process is performed at the time when the printing process is not performed. Here, the case where the focusing process is performed after finishing a job (FIG. 5A), the case where the focusing process is performed at the time of a color registration process (FIG. 5B), and the case where the focusing process is performed after printing a previous sheet and before printing a next sheet (FIG. 5C) will be described in order. First, the focusing process after finishing a job in the optical scanning apparatus will be described with reference to FIG. 5A.

The focusing process after finishing a job starts when starting an image formation. In this optical scanning apparatus, when detecting the start of an image formation, the CPU 48 as a control unit starts to rotate the polygon motor that rotates the polygon mirror 8. At the same time, the CPU 48 starts to supply electronic power for the emission preparation of the semiconductor laser (step S50).

Next, the CPU 48 waits until detecting the reference signal for aligning the writing start position of an image from the BD sensor 9 (NO in the step S51). When receiving the reference signal for aligning the writing start position of an image from the BD sensor 9 (YES in the step S51), the CPU 48 proceeds with the process to step S52, and measures the defocus while performing the APC.

Here, the APC performed by the CPU 48 controls the light amount so as to be a predetermined amount in order to adjust the density of the image in a predetermined level. The CPU (the control unit) 48 controls the light amount of the laser beam that irradiates the image forming area based on the light amount of the laser beam that is separated from the laser beam emitted from the laser light source 1 toward the polygon mirror 8 by the beam splitter 5 and is received by the APC sensor 6. The CPU 48 measures the defocus amount based on the detection signal of an the AF sensor (step S52).

Next, the CPU 48 determines whether the measured defocus amount is below a threshold value (within a tolerance level) (step S53). Then, when determining that the defocus amount is below the threshold value (YES in the step S53), the CPU 48 returns the process to the step S51, and continues the routine from the step S51 to the step S53.

On the other hand, when determining that the measured defocus amount is not below the threshold value (NO in the step S53), the CPU 48 proceeds the process to step S54, and determines whether the job has been completed. When determining that the job has not been completed (NO in the step S54), the CPU 48 returns the process to the step S51, and continues the routine from the step S51 to the step S54.

When determining that the job has been completed (YES in the step S54), the CPU 48 proceeds with the process to step S55.

Next, the CPU 48 executes the focusing after finishing the job, when the CPU 48 determines that the defocus amount exceeds the threshold value as a result of continuing measurement of the defocus amount during the image formation (step S55). In this focusing, the CPU 48 controls the driving motors so as to move the first cylindrical lens 3 for focusing in the principal scanning direction and the second cylindrical lens 4 for focusing in the auxiliary scanning direction along the optical path of the laser beam. At this time, the CPU 48 controls the driving motors so that the first cylindrical lens 3 and the second cylindrical lens 4 move by the focusing amounts (the driving amounts corresponding to the defocus amounts in the principal and auxiliary scanning directions, respectively) detected by the AF sensor in order to correct the defocus.

Next, the CPU 48 waits until detecting the reference signal for aligning the writing start position of an image from the BD sensor 9 in order to check whether the defocus is actually corrected (NO in the step S51). Then, when detecting the reference signal for arranging the writing start position of the image from the BD sensor 9 (YES in the step S56), the CPU 48 proceeds with the process to step S57. Next, the CPU 48 measures the defocus amount based on the detection signal of the AF sensor, while performing the APC (the step S57).

Next, the CPU 48 determines whether the measured defocus amount is below the threshold value (within a tolerance level) (step S58). Then, when determining that the defocus amount is not below the threshold value (NO in the step S58), the CPU 48 returns the process to the step S55, and continues the routine from the step S55 to the step S58.

When determining that the defocus amount is below the threshold value (within the tolerance level) (YES in the step S58), the CPU 48 proceeds with the process to step S59. Then, the CPU 48 stops the polygon motor, stops the emission of the semiconductor laser, and finishes the focusing process after finishing a job.

Figure 5A:
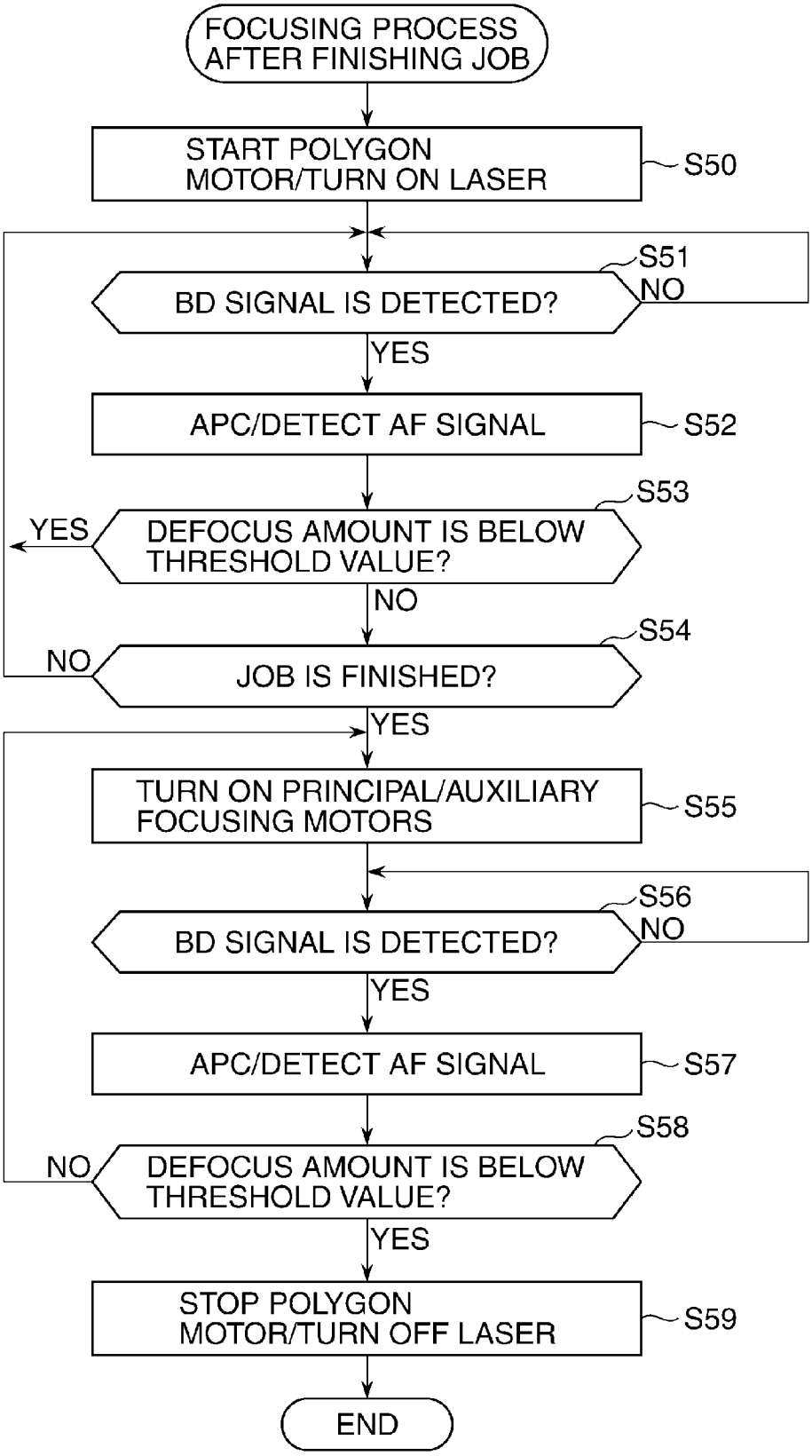
FIG. 5A is a flowchart showing a focusing process performed by the optical scanning apparatus according to the embodiment when the job finishes.
Figure 5B:
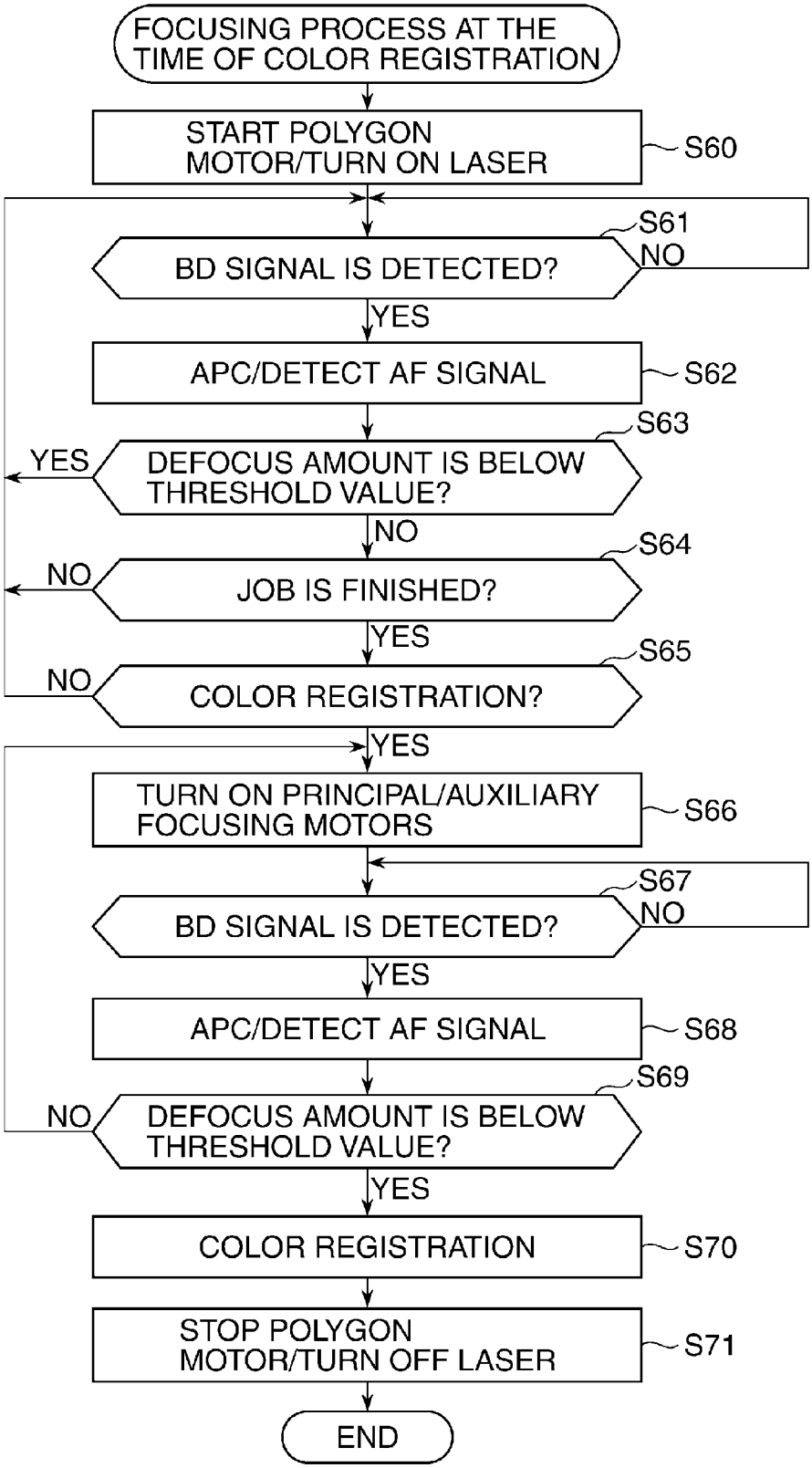
FIG. 5B is a flowchart showing a focusing process performed by the optical scanning apparatus according to the embodiment at the time of color registration.
Figure 5C:
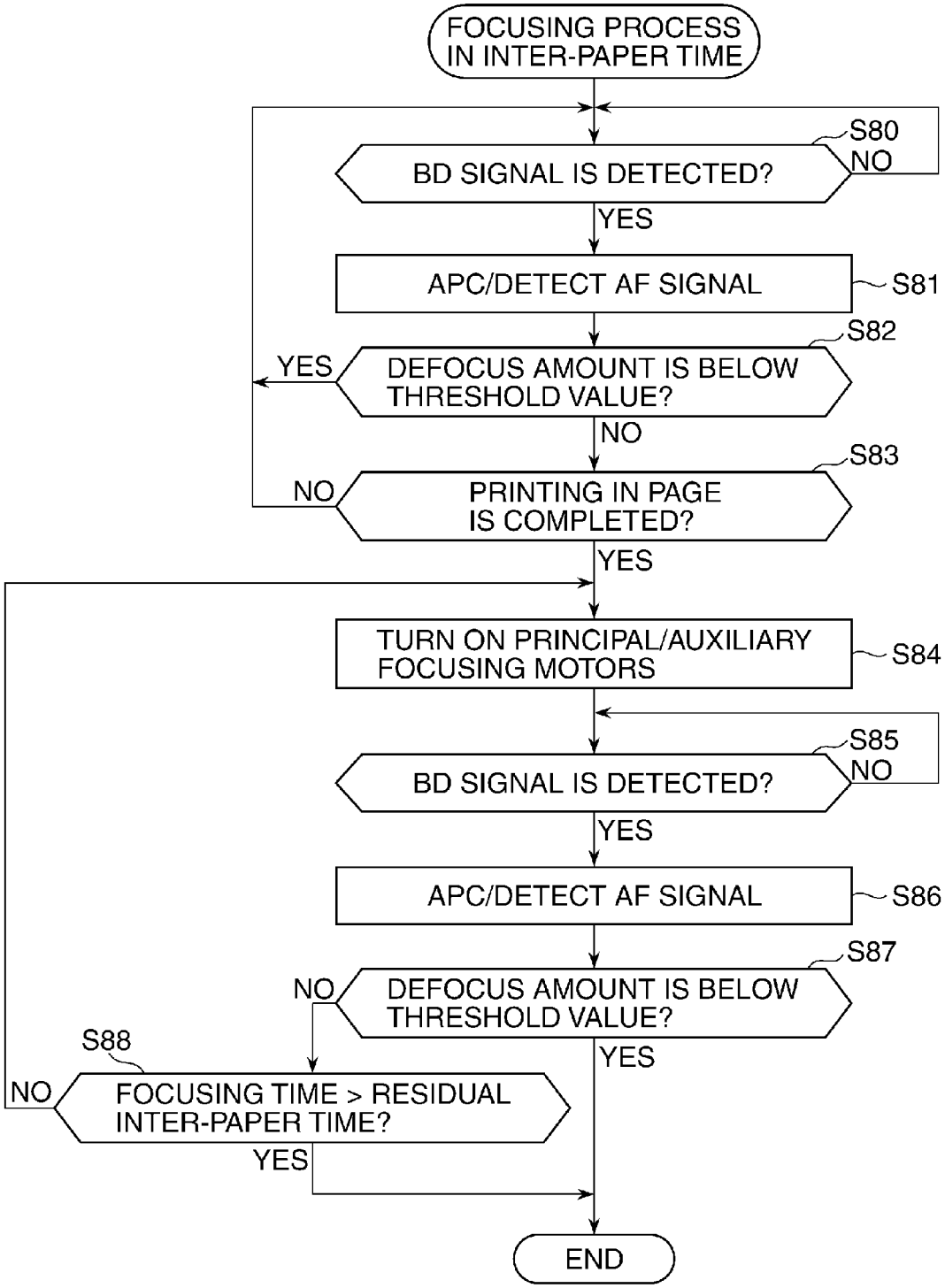
FIG. 5C is a flowchart showing a focusing process performed by the optical scanning apparatus according to the embodiment in inter-paper time.

In the focusing process after finishing a job shown in FIG. 5A, the CPU 48 continues measuring the defocus amount after starting an image formation, while performing the APC. Then, when determining that the defocus amount exceeds the threshold value during performing a job, the CPU 48 executes the focusing process after finishing the job. Then, the CPU 48 finishes the focusing after the defocus amount becomes below the threshold value, stops the polygon motor, and stops the emission of the semiconductor laser.

In the focusing process shown in FIG. 5A, the CPU 48 calculates the driving amounts for the driving motors as the focusing amounts based on the measured defocus amount, and controls the driving motors so as to move the first and second cylindrical lenses at the same time. This focusing process after finishing a job includes the process for checking whether the defocus has been actually corrected after the focusing. If the defocus amount does not become below the threshold value even when the first and second cylindrical lenses are moved by the calculated moving amounts, the lenses may be shifted while monitoring the defocus amount until the defocus amount becomes below the threshold value.

Next, the focusing process in the optical scanning apparatus performed at the time of the color registration in the image forming apparatus shown in the flowchart in FIG. 5B will be described. In this focusing process shown in FIG. 5B, the focusing that was performed after finishing a job in the above-mentioned focusing process shown in FIG. 5A is performed at the time of the color registration in the image forming apparatus.

The focusing process at the time of the color registration starts when starting an image formation. In the optical scanning apparatus, the CPU 48 starts driving the polygon motor that rotates the polygon mirror 8 at the time of starting an image formation. At the same time, the CPU 48 starts to supply electronic power for the emission preparation of the semiconductor laser (step S60).

Next, the CPU 48 waits until detecting the reference signal for aligning the writing start position of an image from the BD sensor 9 (NO in the step S61). When receiving the reference signal for aligning the writing start position of an image from the BD sensor 9 (YES in the step S61), the CPU 48 proceeds with the process to step S62, and measures the defocus while performing the APC.

Next, the CPU 48 determines whether the measured defocus amount is below the threshold value (within a tolerance level) (step S63). Then, when determining that the defocus amount is below the threshold value (YES in the step S63), the CPU 48 returns the process to the step S61, and continues the routine from the step S61 to the step S63.

On the other hand, when determining that the measured defocus amount is not below the threshold value (NO in the step S63), the CPU 48 proceeds the process to step S64, and determines whether the job has been completed. When determining that the job has not been completed (NO in the step S64), the CPU 48 returns the process to the step S61, and continues the routine from the step S61 to the step S64.

Next, the CPU 48 determines whether the color registration is necessary. And when determining that the color registration is unnecessary (NO in the step S65), the CPU 48 returns the process to the step S61, and continues the routine from the step S61 to the step S65. When determining that the color registration is necessary (YES in the step S65), the CPU 48 proceeds with the process to step S66. When the CPU determines that the defocus amount exceeds the threshold value as a result of continuing the measurement of the defocus amount during the image formation, the CPU 48 performs the focusing at the timing of the color registration. In this focusing, the CPU 48 controls the driving motors so as to move the first cylindrical lens 3 for focusing in the principal scanning direction and the second cylindrical lens 4 for focusing in the auxiliary scanning direction along the optical path of the laser beam. At this time, the CPU 48 controls the driving motors so that the first cylindrical lens 3 and the second cylindrical lens 4 move by the focusing amounts (the driving amounts corresponding to the defocus amount) detected by the AF sensor in order to correct the defocus.

Next, the CPU 48 waits until detecting the reference signal for aligning the writing start position of an image from the BD sensor 9 in order to check whether the defocus is actually corrected (NO in the step S67). Then, when detecting the reference signal for arranging the writing start position of the image from the BD sensor 9 (YES in the step S67), the CPU 48 proceeds with the process to step S68. Next, the CPU 48 measures the defocus amount based on the detection signal of the AF sensor, while performing the APC (the step S68).

Next, the CPU 48 determines whether the measured defocus amount is below the threshold value (within a tolerance level) (step S69). Then, when determining that the defocus amount is not below the threshold value (NO in the step S69), the CPU 48 returns the process to the step S66, and continues the routine from the step S66 to the step S69.

When determining that the defocus amount is below the threshold value (within the tolerance level) (YES in the step S69), the CPU 48 proceeds with the process to step S70. The CPU 48 performs the color registration (the step S70), and then, proceeds with the process to step S71. Then, the CPU 48 stops the polygon motor, stops the emission of the semiconductor laser (the step S71), and finishes the focusing process at the time of the color registration.

In the above-mentioned focusing process at the time of the color registration, it is preferable that the color registration is performed after the defocus of the optical system was corrected. This is because the clearer image used for calculating the registration value improves reading accuracy of the image when calculating the registration value based on the image formed on an intermediate transfer belt, for example. Accordingly, in this focusing process at the time of the color registration, the color registration accuracy is improvable by the focusing before forming the image for the color registration.

In the focusing process at the time of the color registration, if the apparatus is stopped for the focusing, downtime becomes long and productivity of the apparatus is reduced. Accordingly, in the focusing process at the time of the color registration shown in FIG. 5B, the apparatus is not stopped even when the defocus amount exceeds the threshold value, and the focusing is performed when the apparatus is stopped for the color registration. According to the focusing process shown in FIG. 5B, the defocus is corrected without increasing the downtime of the apparatus.

Next, the focusing process in the optical scanning apparatus performed between jobs for printing a plurality of sheets shown in the flowchart in FIG. 5C will be described.

The focusing process in the inter-paper time starts when starting the image formation. In the optical scanning apparatus, the CPU 48 waits until detecting the reference signal for aligning the writing start position of an image from the BD sensor 9 (NO in the step S80). When receiving the reference signal for aligning the writing start position of an image from the BD sensor 9 (YES in the step S80), the CPU 48 proceeds with the process to step S81, and measures the defocus while performing the APC.

Next, the CPU 48 determines whether the measured defocus amount is below the threshold value (within a tolerance level) (step S82). Then, when determining that the defocus amount is below the threshold value (YES in the step S82), the CPU 48 returns the process to the step S80, and continues the routine from the step S80 to the step S82.

On the other hand, when determining that the measured defocus amount is not below the threshold value (NO in the step S82), the CPU 48 proceeds the process to step S83, and determines whether the printing in a page has been completed (the step S83). When determining that the printing in the page has not been completed (NO in the step S83), the CPU 48 returns the process to the step S80, and continues the routine from the step S80 to the step S84. When determining that the printing in the page has been completed (YES in the step S83), the CPU 48 proceeds with the process to step S84.

Next, the CPU 48 performs the focusing when the CPU 48 determines that the defocus amount exceeds the threshold value as a result of continuing measurement of the defocus amount during the image formation (the step S84). In this focusing, the CPU 48 controls the driving motors so as to move the first cylindrical lens 3 for focusing in the principal scanning direction and the second cylindrical lens 4 for focusing in the auxiliary scanning direction along the optical path of the laser beam. At this time, the CPU 48 controls the driving motors so that the first cylindrical lens 3 and the second cylindrical lens 4 move by the focusing amounts (the driving amounts corresponding to the defocus amount) detected by the AF sensor in order to correct the defocus.

Next, the CPU 48 waits until detecting the reference signal for aligning the writing start position of an image from the BD sensor 9 in order to check whether the defocus is actually corrected (NO in step S85). Then, when detecting the reference signal for arranging the writing start position of the image from the BD sensor 9 (YES in the step S85), the CPU 48 proceeds with the process to step S86. Next, the CPU 48 measures the defocus amount based on the detection signal of the AF sensor, while performing the APC (the step S86).

Next, the CPU 48 determines whether the measured defocus amount is below the threshold value (within a tolerance level) (step S87). When determining that the defocus amount is below the threshold value (within the tolerance level) (YES in the step S87), the CPU 48 finishes the focusing process in the inter-paper time.

When determining that the defocus amount is not below the threshold value (NO in the step S87), the CPU 48 proceeds with the process to step S88. Then, the CPU 48 determines whether the time required for the focusing is longer than residual inter-paper time (step S88). When determining that the time required for the focusing is not longer (is shorter) than the residual inter-paper time (NO in the step S88), the CPU 48 returns the process to the step S84, and continues the routine from the step S84 to the step S88.

When determining that the time required for the focusing is longer than the residual inter-paper time (YES in the step S88), the CPU 48 finishes the focusing process in the inter-paper time.

In the above-mentioned focusing process in the inter-paper time, the lenses for focusing are moved at the timing in the inter-paper time during which an image is not formed. Although the inter-paper time varies with product types of image forming apparatuses, the available time for the focusing in the inter-paper time is extremely shorter than the available time for focusing after finishing a job or the available time for focusing at the time of color registration. Accordingly, in the focusing process in the inter-paper time, the defocus is measured every time the APC is performed. Then, when the amount of the occurred defocus exceeds a correcting resolution using the optical element, the focusing is performed at that stage, for example. Such a configuration enables completion of the focusing even in the short time in the inter-paper time by reducing the correction amount for one time, which controls the excessive downtime of the image forming apparatus.

In the above-mentioned embodiment, the focusing optical system is not limited to the elements that have independent powers in the principal and auxiliary scanning directions, respectively. For example, the focusing optical system may comprise a first adjustment lens that has the powers in both the principal and auxiliary scanning directions and a second adjustment lens that has the power in one of the principal and auxiliary scanning directions.

When detecting the defocus amounts of the laser beams, the AF optical system does not only detect the beams from the center emission point and the emission points of both ends, but also may detect the beams from all the emission points and calculate the focusing amount based on the detection results. As long as the same effect is acquired, the correction sequence is not limited to the above-mentioned order. For example, the order of the BD detection, the APC, and the AF signal detection may be reverse. The optical arrangement, which includes the lens arrangements, the shape of the polygon mirror, the sensor arrangements, etc., is not limited to that shown in the above-mentioned embodiment. For example, the AF sensor and the separator lens may be arranged at the position where the laser beams that do not pass through the fθ lens are detected that can detect defocus, as long as the defocus can be detected.

In the configuration of the embodiment, since the laser emission for the APC is also used for the defocus detection in every term within the one scan period, the number of emissions of the semiconductor laser can be reduced. Accordingly, the configuration of the embodiment shortens the emission time of the semiconductor laser as compared with the configuration that emits the semiconductor laser for the APC and the defocus detection independently. Since this optical scanning apparatus scans many times, the shortened emission time for one scan period is accumulated and enormous amounts of the emission time of the semiconductor laser can be saved, which extends the use life of the semiconductor laser in the optical scanning apparatus.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-016663, filed on Jan. 30, 2012, which is hereby incorporated by reference herein in its entirety.

What is claimed is:

1. An optical scanning apparatus comprising:

a light source configured to emit a plurality of laser beams;

a deflector configured to deflect the laser beam so that the laser beam emitted from said light source scans a photoconductor;

a beam splitter configured to separate the laser beam emitted from said light source toward said deflector, said beam splitter being arranged between said light source and said deflector on an optical path of the laser beam;

a first detection unit configured to detect a laser beam separated from the laser beam emitted from said light source toward said deflector;

an optical element configured to guide the laser beam deflected by said deflector to the photoconductor;

a second detection unit configured to detect the laser beam deflected by said deflector in order to detect defocus amount of the laser beam guided to the photoconductor, said second detection unit being arranged at a position corresponding to a non-image forming area outside an image forming area of the photoconductor;

a focusing unit configured to focus the scanning laser beam onto the photoconductor based on a detection result of said second detection unit; and a control unit configured to control said light source, wherein said control unit controls said light source so that the respective laser beams impinge on said first detection unit at different timings and controls the light amount of the respective laser beams based on detection results of said first detection unit, and wherein said control unit controls said light source so that a laser beam, which is used for correcting defocus thereof, among the plurality of laser beams impinges on said second detection unit and controls the light amount of the laser beam used for correcting defocus thereof based on detection result of said first detection unit of a laser beam separated from the laser beam used for correcting defocus thereof by said beam splitter when the laser beam used for correcting defocus thereof beams impinges on said second detection unit.

2. The optical scanning apparatus according to claim 1, wherein said focusing unit is provided with a lens through which the laser beam passes, and a moving mechanism that moves the lens along with the optical path of the laser beam in order to move the focus of the laser beam, said second detection unit is provided with a light receiving element having pixels that are arranged two-dimensionally, and said control unit acquires the defocus amount of the laser beam depending on the output signal of the light receiving element, and controls said moving mechanism so as to move the lens based on the acquired defocus amount.

3. The optical scanning apparatus according to claim 2, wherein the lens included in said focusing unit is arranged between said light source unit and the deflector.

4. A color image forming apparatus equipped with the optical scanning apparatus according to claim 1, wherein said control unit controls said focusing unit to focus at the timing of a color registration when the defocus amount detected by said second detection unit exceeds a threshold value.

5. The color image forming apparatus according to claim 4, wherein said control unit controls said focusing unit for focusing before the color registration.

6. A color image forming apparatus equipped with the optical scanning apparatus according to claim 1, wherein said control unit controls said focusing unit to focus in inter-paper time during which an image is not formed when the defocus amount detected by said second detection unit exceeds the threshold value.

* * * * *